US006923313B1

(12) United States Patent
Orogun-Thomas

(10) Patent No.: US 6,923,313 B1
(45) Date of Patent: Aug. 2, 2005

(54) EYEGLASSES POLISHER/HOLDER DEVICE

(76) Inventor: Bamidele Orogun-Thomas, 215 Imad Ct., Fairburn, GA (US) 30213

( * ) Notice: Subject to any disclaimer, the term of this patent is extended or adjusted under 35 U.S.C. 154(b) by 80 days.

(21) Appl. No.: 10/369,890

(22) Filed: Feb. 21, 2003

(51) Int. Cl.[7] ..... A45C 11/04
(52) U.S. Cl. ..... 206/5
(58) Field of Search ..... 206/5, 6; 15/214

(56) References Cited

U.S. PATENT DOCUMENTS

| | | | | |
|---|---|---|---|---|
| 1,242,187 A | | 10/1917 | Hayder | |
| 1,339,330 A | * | 5/1920 | Goelkel | 206/6 |
| 2,332,266 A | * | 10/1943 | Segal | 206/6 |
| 3,369,651 A | | 2/1968 | Crowley | |
| 4,269,306 A | | 5/1981 | Feniger | |
| 4,287,985 A | * | 9/1981 | Feniger | 206/5 |
| 4,290,522 A | * | 9/1981 | Takasaki | 206/5 |
| 4,347,010 A | | 8/1982 | Petkoff | |
| 4,782,941 A | | 11/1988 | Freise | |
| 5,344,002 A | | 9/1994 | Baczkowski | |
| D366,758 S | | 2/1996 | Weiler | |
| 5,513,744 A | * | 5/1996 | Yabarra | 206/5 |
| 5,626,224 A | * | 5/1997 | Clark et al. | 206/5 |
| 6,439,379 B2 | * | 8/2002 | Taormina | 206/5 |

* cited by examiner

*Primary Examiner*—Bryon P. Gehman

(57) ABSTRACT

An eyeglasses polisher/holder device for cleaning one's eyeglasses by simply sliding the eyeglasses in and out of the container. The eyeglasses polisher/holder device includes a container having an opening therein and also having a storage compartment disposed therein for storing a user's eyeglasses; and also includes a cover assembly including a cover member for removably closing the opening into the container; and further includes an eyeglass cleaner being disposed in the container for cleaning the user's eyeglasses.

2 Claims, 5 Drawing Sheets

EYEGLASSES POLISHER/HOLDER DEVICE

BACKGROUND OF THE INVENTION

1. Field of the Invention

The present invention relates to combination eyeglasses polishers/holders and more particularly pertains to a new eyeglasses polisher/holder device for cleaning one's eyeglasses by simply sliding the eyeglasses in and out of the container.

2. Description of the Prior Art

The use of combination eyeglasses polishers/holders is known in the prior art. More specifically, combination eyeglasses polishers/holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,269,306; U.S. Pat. No. 5,344,002; U.S. Pat. No. 3,369,651; U.S. Pat. No. 4,782,941; U.S. Pat. No. 1,242,187; U.S. Pat. No. 4,347,010; and U.S. Pat. No. Des. 366,758.

While these devices fulfill their respective, particular objectives and requirements, the aforementioned patents do not disclose a new eyeglasses polisher/holder device. The prior art includes glass cases and cover members.

SUMMARY OF THE INVENTION

The general purpose of the present invention, which will be described subsequently in greater detail, is to provide a new eyeglasses polisher/holder device which has many of the advantages of the combination eyeglasses polishers/holders mentioned heretofore and many novel features that result in a new eyeglasses polisher/holder device which is not anticipated, rendered obvious, suggested, or even implied by any of the prior art combination eyeglasses polisher/holders, either alone or in any combination thereof. The present invention includes a container having an opening therein and also having a storage compartment disposed therein for storing a user's eyeglasses; and also includes a cover assembly including a cover member for removably closing the opening into the container; and further includes an eyeglas cleaner being disposed in the container for cleaning the user's eyeglasses. None of the prior art includes the combination of the elements of the present invention.

There has thus been outlined, rather broadly, the more important features of the eyeglasses polisher/holder device in order that the detained description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new eyeglasses polisher/holder device which has many of the advantages of the combination eyeglasses polishers/holders mentioned heretofore and many novel features that result in a new eyeglasses polisher/holder device which is not anticipated, rendered obvious, suggested, or even implied by any of the prior art combination eyeglasses polishers/holders, either alone or in any combination thereof.

Still another object of the present invention is to provide a new eyeglasses polisher/holder device for cleaning one's eyeglasses by simply sliding the eyeglasses in and out of the container.

Still yet another object of the present invention is to provide a new eyeglasses polisher/holder device that is easy and convenient to use.

Even still another object of the present invention is to provide a new eyeglasses polisher/holder device that allows the user to clean one's eyeglasses in one easy step by simply doing what the user would have to do and that is store one's eyeglasses in the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
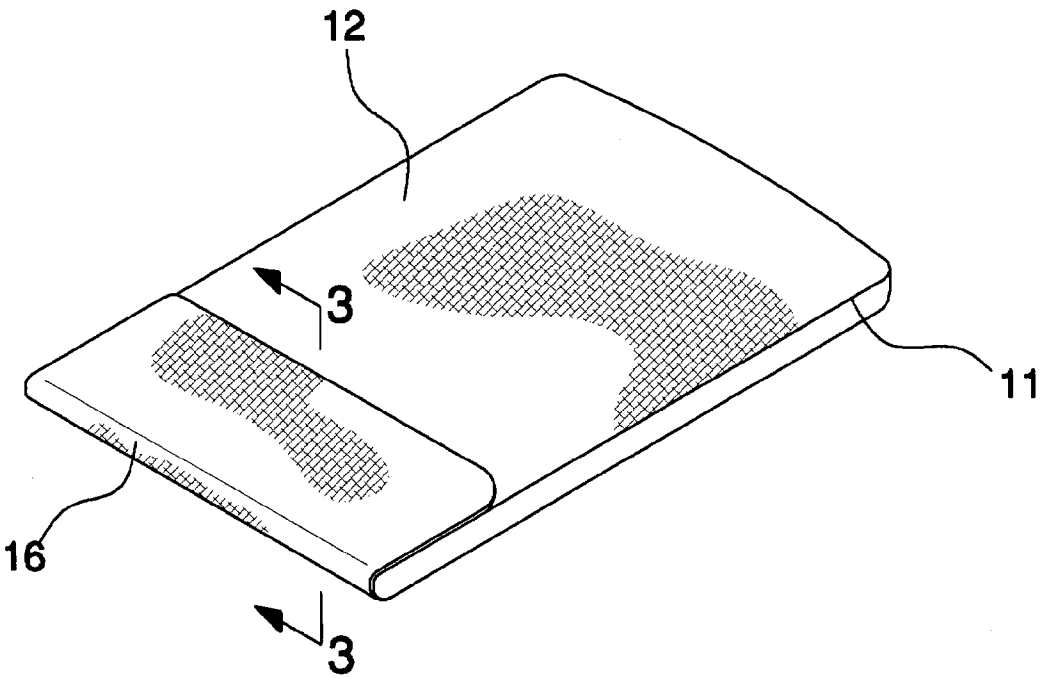
FIG. 1 is a perspective view of a new eyeglasses polisher/holder device according to the present invention.
Figure 2:
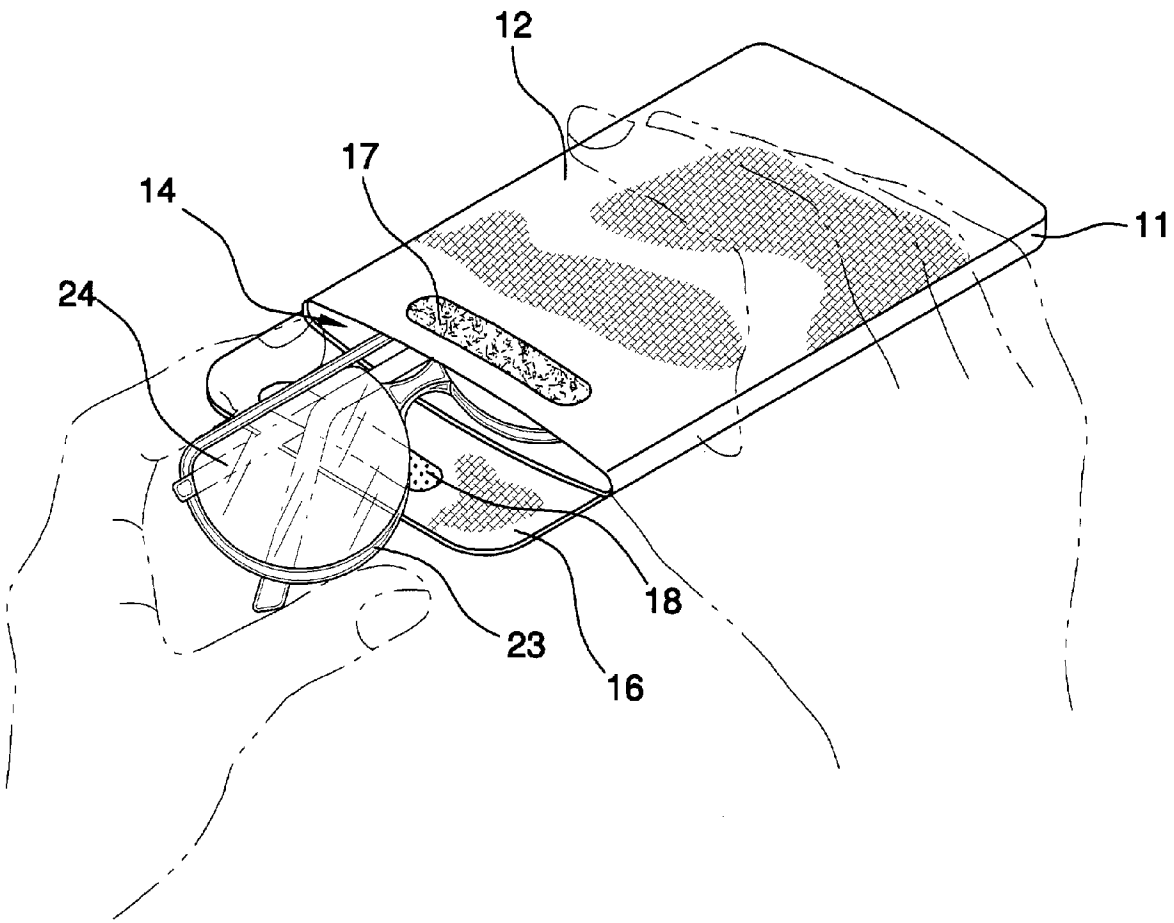
FIG. 2 is another perspective view of the present invention.
Figure 3:
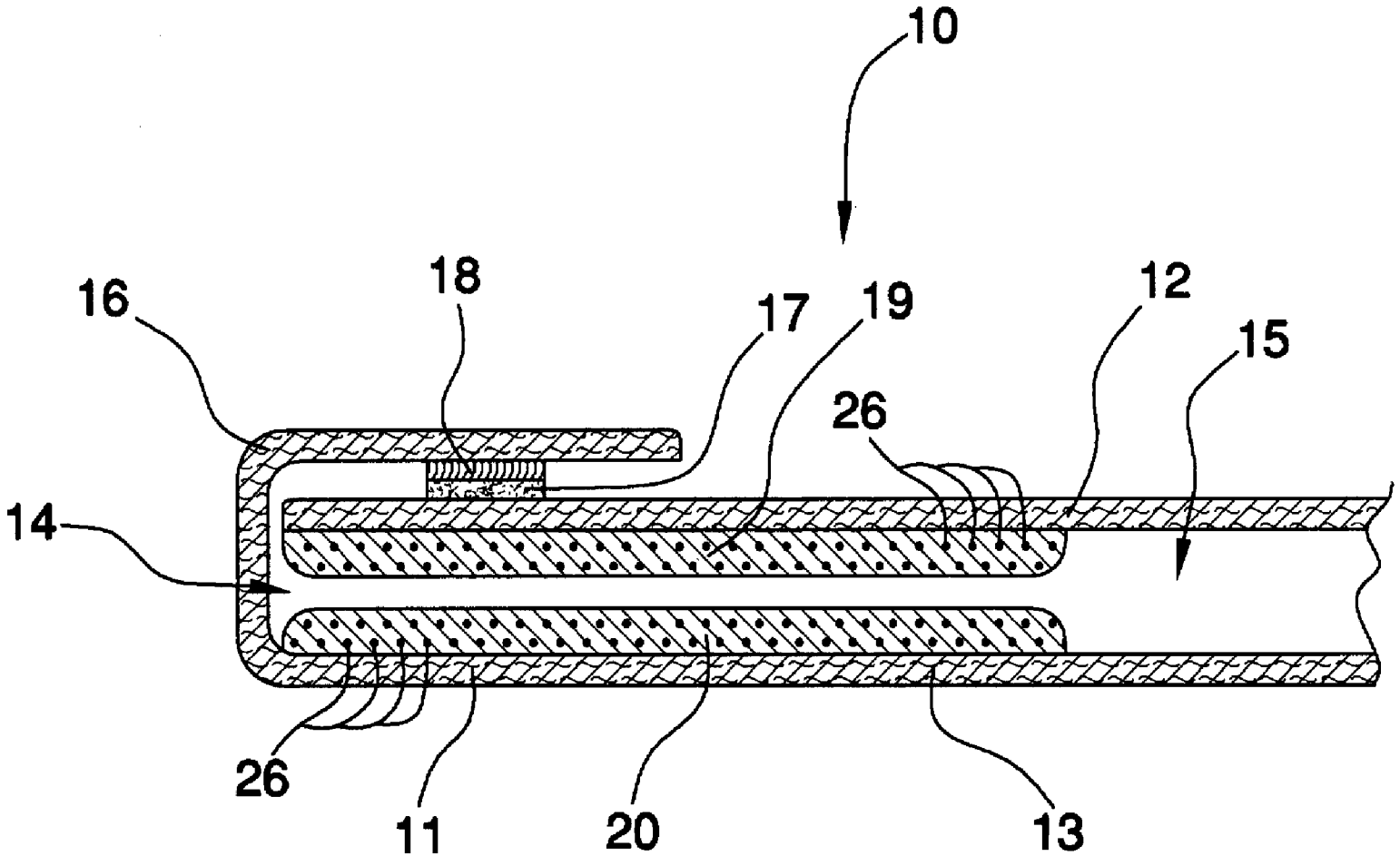
FIG. 3 is a cross-sectional view of the present invention.
Figure 4:
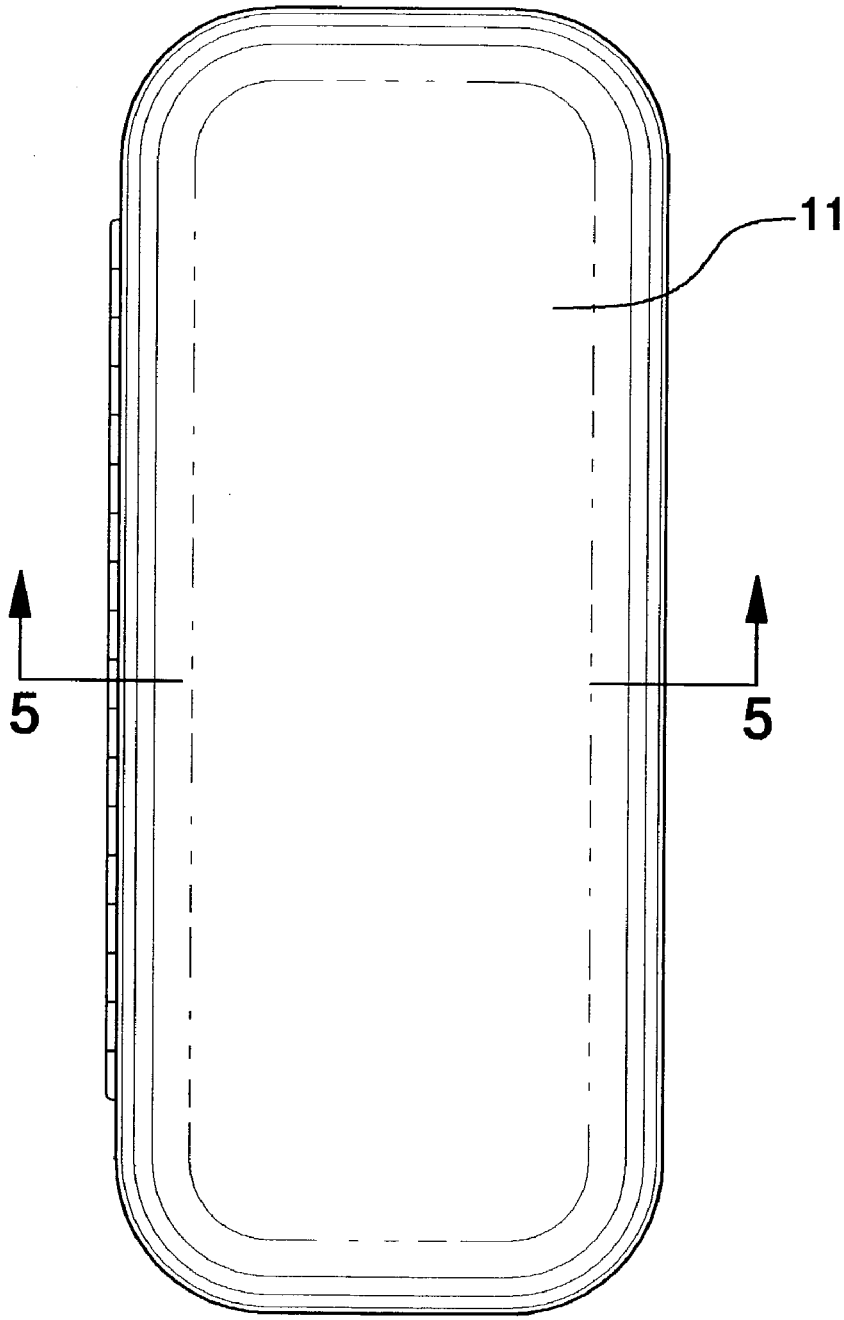
FIG. 4 is a side elevational view of a second embodiment of the present invention.
Figure 5:
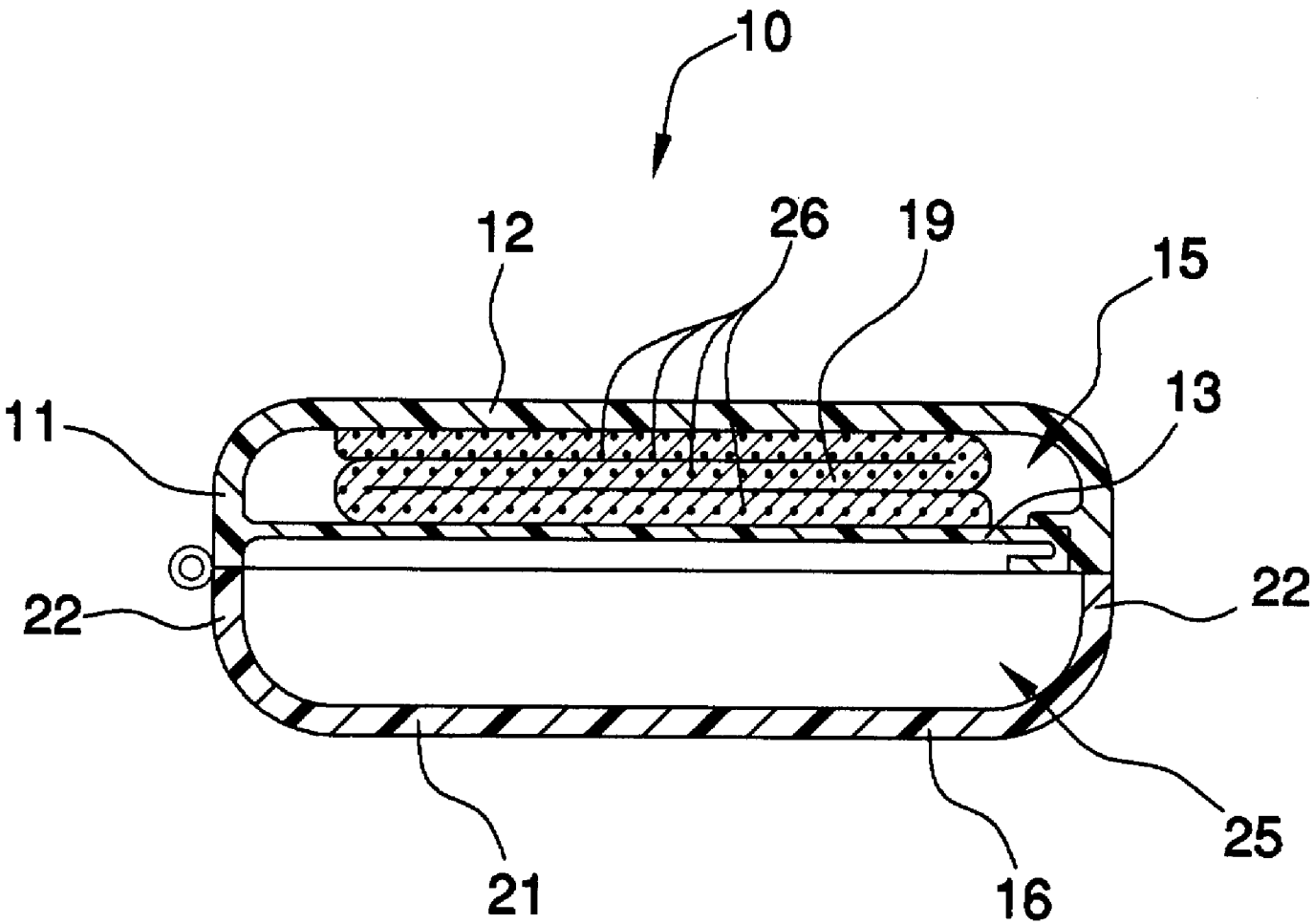
FIG. 5 is a cross-sectional view of the second embodiment of the present invention.

With reference now to the drawings, and in particular to FIGS. 1 through 5 thereof, a new eyeglasses polisher/holder device embodying the principles and concepts of the present invention and generally designated by the reference numeral 10 will be described.

As best illustrated in FIGS. 1 through 5, the eyeglasses polisher/holder device 10 generally comprises a container 11 having an opening 14 therein and also having a storage compartment 15 being disposed therein for storing a user's eyeglasses 23. The container 11 has side walls 12,13 defining the storage compartment 15 therein.

A cover assembly includes a cover member 16 for removably closing the opening 14 into the container 11. The cover member 16 is a flexible flap having an edge which is integrally attached to an outer edge of one of the side walls 12,13 of the container 11 with the flexible flap being detachably attachable to an outer side of the other of the side walls 12,13 of the container 11 to close the opening 14 into the container 11. The cover assembly includes fastener members 17,18 being securely attached and sewn to the container 11 and to the cover member 16 for fastening the cover member 16 over the opening 14 into the container 11. The fastener members 17,18 are strips of hook and loop fasteners.

An eyeglass cleaner 19,20,26 is securely disposed in the container 11 for cleaning the user's eyeglasses 23. The eyeglass cleaner 19,20,26 includes pieces of cloth material 19,20 being securely attached to the side walls 12,13 in the storage compartment 15 of the container 11, and being saturated with a conventional eyeglass cleaning solution 26. The pieces of cloth material 19,20 are closely spaced apart thus forming a channel therebetween for the user's eyeglasses 23 to be disposed. The pieces of cloth material 19,20 engages and cleans the lenses 24 of the user's eyeglasses 23 as the user removes one's eyeglasses 23 from the container 11.

As a second embodiment, the cover member 16 has main and side walls 21,22 and also a storage compartment 25 for the user's eyeglasses 23. One of the side walls 22 of the cover member 16 is hingedly attached to one of the side walls 12,13 of the container 11. The eyeglass cleaner 19,26 is a piece of cloth material being removably disposed in the storage compartment 15 of the container 11 and being saturated with eyeglass cleaning solution 26 for cleaning the lenses 24 of the user's eyeglasses 23.

In use, the user slides the eyeglasses 23 out of the storage compartment 15, and as he/she does so, the lenses 24 of the eyeglasses 23 rub against the pieces of cloth material 19,20 as the eyeglasses 23 are removed from the container and the eyeglass cleaning solution 26 cleans the lenses 24 of the eyeglasses 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the eyeglasses polisher/holder device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An eyeglasses polisher/holder device comprising:

a container having an opening therein and also having a storage compartment disposed therein for storing a user's eyeglasses, said container having side walls defining said storage compartment therein;

a cover assembly including a cover member for removably closing said opening into said container, said cover member being a flexible flap having an edge which is integrally attached to an outer edge of one of said side walls of said container, said flexible flap being detachably attachable to an outer side of an opposed said side wall of said container to close said opening into said container, said cover assembly including fastener members being attached to said container and to said cover member for fastening said cover member over said opening into said container, said fastener members being strips of hook and loop fasteners; and an eyeglass cleaner being disposed in said container for cleaning the user's eyeglasses, said eyeglass cleaner including pieces of cloth material being attached to said side walls in said storage compartment of said container, and being saturated with an eyeglass cleaning solution, said pieces of cloth material being closely spaced apart thus forming a channel therebetween for the user's eyeglasses to be disposed, said pieces of cloth material engaging and cleaning the lenses of the user's eyeglasses as the user removes one's eyeglasses from said container through said channel.

2. A method of cleaning eyeglasses includes the steps of:

providing a container having side walls and an opening disposed therein, and also having a storage compartment disposed therein, and further having pieces of cloth material attached to said side walls in said storage compartment of said container to define a channel and being saturated with a cleaning solution;

sliding the eyeglasses out of said storage compartment through said channel; and cleaning of the lenses of the eyeglasses with the cleaning solution as the lenses rub against said pieces of cloth material as the eyeglasses are being removed from said container through said channel.

* * * * *